United States Patent [19]

Oniki et al.

[11] 4,377,146

[45] Mar. 22, 1983

[54] VAPORIZED FUEL CONTROLLER FOR A CARBURETOR

[75] Inventors: Tetsuya Oniki, Anjyo; Kunio Kadowaki, Ohbu, both of Japan

[73] Assignee: Aisan Industry Co., Ltd., Aichi, Japan

[21] Appl. No.: 137,156

[22] Filed: Apr. 4, 1980

[30] Foreign Application Priority Data

May 2, 1979 [JP] Japan ..... 54/59226[U]

[51] Int. Cl.[3] ..... F02M 33/02

[52] U.S. Cl. ..... 123/520; 261/DIG. 67; 137/DIG. 8; 137/625.5

[58] Field of Search ..... 123/520, 519, 518, 521; 261/DIG. 67; 251/77; 137/DIG. 8, 625.5, 625.27

[56] References Cited

U.S. PATENT DOCUMENTS

| | | | |
|---|---|---|---|
| 2,942,622 | 6/1960 | Hahn et al. | 251/77 |
| 3,548,797 | 12/1970 | Hagihara et al. | 123/519 |
| 4,083,344 | 4/1978 | Sakurai et al. | 123/520 |
| 4,085,721 | 4/1978 | Vardi et al. | 123/520 |
| 4,149,504 | 4/1979 | Walters | 123/520 |
| 4,258,685 | 3/1981 | Arai et al. | 123/520 |
| 4,283,356 | 8/1981 | Arai et al. | 123/519 |

FOREIGN PATENT DOCUMENTS

| | | | |
|---|---|---|---|
| 52-11336 | 1/1977 | Japan | 123/520 |

*Primary Examiner*—Ira S. Lazarus
*Assistant Examiner*—Magdalen Moy

[57] ABSTRACT

A vaporized fuel controller for a carburetor which utilizes the negative pressure in the intake manifold and electromagnet to actuate a changeover valve so as to connect the gas chamber of the float chamber to the inner vent when the engine is running, and to the canister when the engine is not running. With this invention, when the negative pressure in the intake manifold decreases while the engine is running at high speeds, the electromagnet keeps the valve from being moved by the spring force and maintains the valve at a position such that the vapor fuel is supplied to the intake manifold through the inner vent.

8 Claims, 1 Drawing Figure

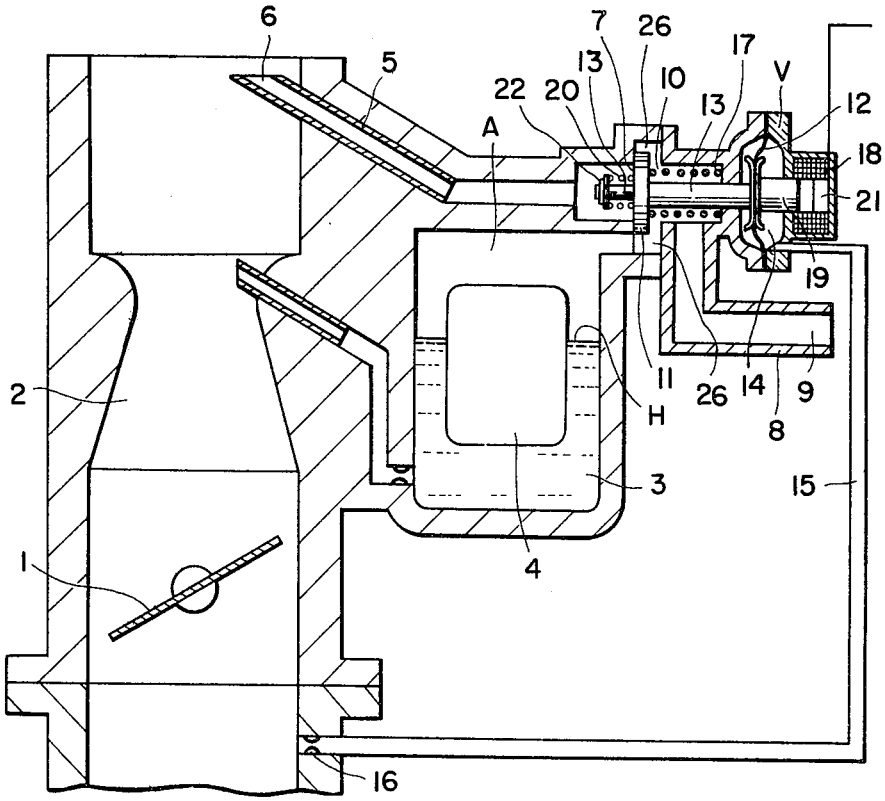
6
5
7
26
17
13
10
V
22
20
13
12
A
18
21
19
2
11
26
14
9
H
8
3
15
1
4
16

VAPORIZED FUEL CONTROLLER FOR A CARBURETOR

BACKGROUND OF THE INVENTION

This invention relates to a mechanism for controlling vapor fuel generated in the float chamber of a carburetor.

In the conventional vaporized fuel controllers, the gas chamber of the float chamber becomes connected to the inner vent or the charcoal canister by changing over a valve, which is actuated either by (1) the negative pressure in the intake manifold only or by (2) the intake manifold negative pressure combined with some mechanical interlocking means or with an electromagnet. However, with the first method (1), reduction in the negative pressure caused while the engine is running at high speeds closes the passage leading to the inner vent and opens the passage to the canister, thus connecting the gas chamber to the canister and wasting the vapor fuel. As a countermeasure to the first method, the second method (2) has been proposed to change over the valve. However, this method has a disadvantage that the mechanical interlocking means becomes very complicated.

SUMMARY OF THE INVENTION

An object of this invention is to provide a mechanism for controlling the vapor fuel which overcomes the above-mentioned drawbacks experienced with the conventional devices.

To achieve this objective, a vaporized fuel controller of this invention comprises: a vapor fuel exhaust passage provided to a gas chamber A of a float chamber 3, two passages provided from the exhaust passage, one communicating with an inner vent 5 and the other communicating with a canister, the openings 7 and 10 of the passages opposing each other squarely across the exhaust passage, a changeover valve provided between the openings of the passages to alternately open and close the openings, the valve being disposed so that the valve disc 11 slides freely along the valve stem with springs 10 and 20 acting on the surfaces of the valve disc 11, and associated with a negative pressure valve V and an electromagnet 18 both acting on the valve in such a manner that the opening 7 on the inner vent side is opened while the engine is running, and the opening 10 on the canister side is opened while the engine is stopped, such that the function is relative to the operation of the engine.

BRIEF DESCRIPTION OF THE DRAWING

The accompanying drawing is a cross-sectional view showing one embodiment of this invention.

DESCRIPTION OF THE PREFERRED EMBODIMENT

A preferred embodiment of the present invention will now be described with reference to the accompanying drawing.

A throttle valve 1 is installed in an intake manifold 2. A float chamber 3 has an oil level H maintained at a constant level by a float 4 and a gas chamber A and a vapor fuel exhaust passage 26 communicating therewith. An inner vent 5 opens at one end 6 into the upstream of the intake manifold 2 and at the other end 7 (also referred to as opening 7) opens into the vapor fuel exhaust passage 26 and thereby into the gas chamber A of the float chamber 3. A passage 8 communicates at one end 9 with a charcoal canister (not shown) and at the other end 10 (also referred to as opening 10) with the vapor fuel exhaust passage 26 and thereby with the gas chamber A. A negative pressure valve V has a negative pressure chamber 14 defined by a diaphragm mechanism 12, the negative pressure chamber 14 being connected by a passage 15 to the downstream of the throttle valve 1. The diaphragm mechanism 12 is fitted, through a valve stem 13, with a valve disc 11 which faces the opening 7 on one side and the other opening 10 on the other side. A spring 17 urges the valve disc 11 toward the opening 7. A throttle 16 is provided in the passage 15. The negative pressure valve V also has an electromagnet 18 and a valve stem 19 actuated by the electromagnet 18, the electromagnet 18 and the stem 19 being disposed on the negative pressure chamber side opposite to that of the valve stem 13 and the valve disc 11 with respect to the diaphragm. A spring 20 is supported by a spring support plate 22 and urges the valve disc 11 toward the opening 10 against the spring 17. The electromagnet 18 is connected to a key switch or an alternator. The electromagnet has a core 21.

We will explain the action of this device in the following.

When the engine is at rest, no negative pressure develops in the intake manifold and no current flows in the electromagnet so that the spring 17 causes the valve disc 11 to close the opening 7 and opens the opening 10, thereby leading the fuel vapor generated in the float chamber 3 through the passage 8 to the canister. When the engine is started, the negative pressure developed in the intake manifold causes the diaphragm mechanism to move the valve disc 11 toward the right against the biasing of the spring 17 to open the opening 7 and close the opening 10. The valve stem 19 is attracted to the core 21 by the action of the electromagnet 18. After the valve disc 11 is stopped by abutting against the wall forming the opening 10, the spring 20 supported by the support plate 22 is compressed allowing the valve stems 13, 19 to continue to move toward the core 21 of the electromagnet until the end of the valve stem 19 comes into contact with and is held firmly by the core 21.

When the engine is running at high speeds, the negative pressure in the intake manifold becomes small. Then, the spring 17 tends to cause the valve disc 11 to move away from the opening 10, but the electromagnet 18 holds the valve disc 11 in the same position, opening the opening 7 and closing the opening 10.

With this invention, the vapor fuel in the float chamber is prevented from getting out into the atmosphere or into the intake manifold, thereby precluding air pollution and ensuring smooth starting of the engine. Since the vapor fuel is supplied to the intake manifold during engine operation, full engine performance can be obtained. This invention also has an advantage of simple construction. As can be seen in the foregoing, this invention overcomes various drawbacks experienced with the conventional devices.

What is claimed is:

1. In an engine a vaporized fuel controller for a carburetor having a vapor fuel exhaust passage communicating with a gas chamber of a float chamber, and two passages via openings thereof, respectively, communicating with said exhaust passage, one of said two passages communicating with an inner vent and the other of said two passages communicating with a canister, the improvement wherein said openings of said two passages opposing each other across said exhaust passage, means comprising a changeover valve between said openings of said two passages for alternately opening and closing said openings, said valve having a valve stem and a valve disc operatively freely slidable along said valve stem and springs acting on surfaces of said valve disc, a negative pressure valve and an electromagnet both operatively acting on said changeover valve in such a manner that via said valve disc the opening to said one of said two passages on the inner vent side is opened while the engine is running, and the opening to said other of said two passages on the canister side is opened while the engine is stopped, such that function is relative to the operation of the engine, said openings oppose each other squarely aligned across said exhaust passage, said valve stem extends through said openings and has a free end on which one of said springs is mounted, said one of said springs and the other of said springs engage opposite of said surfaces of said valve disc, and said negative pressure valve is connected to another end of said valve stem and to said electromagnet.

2. The vaporized fuel controller according to claim 1, further comprising a housing defining a valve chamber in which said negative pressure valve is disposed, the latter including a movable diaphragm mechanism connected to said housing dividing said valve chamber and forming a negative pressure chamber on one side thereof communicating with an intake manifold of the carburetor downstream of a throttle valve disposed in the intake manifold, said inner vent communicates with said intake manifold upstream of the throttle valve.

3. The vaporized fuel controller according to claim 2, wherein said electromagnet includes a winding, a core mounted in the winding and another valve stem connected to said diaphragm mechanism on one side thereof and displaceably extending into said winding spaced from and adjacent said core respectively, said first-mentioned valve stem of said changeover valve is connected to said diaphragm mechanism on the other side thereof.

4. The vaporized fuel controller according to claim 3, wherein the other of said springs extends through the opening to said other of said two passages and is mounted against an outside of said housing, and said first-mentioned valve stem of said changeover valve displaceably extends through said housing into said valve chamber.

5. The vaporized fuel controller according to claim 4, wherein said winding is connected to a key switch.

6. The vaporized fuel controller according to claim 4, wherein said winding is connected to an alternator.

7. The vaporized fuel controller according to claim 1, further comprising a support plate is secured to said free end of said valve stem, said one spring is mounted on said support plate.

8. The vaporized fuel controller according to claim 4, wherein said first-mentioned valve stem of said changeover valve has a larger diameter portion and a smaller diameter portion, said valve disc is displaceably mounted on said smaller diameter portion.

* * * * *